United States Patent [19]

Marti

[11] 3,935,370

[45] Jan. 27, 1976

[54] PROCESS FOR PREPARING FLOCK FIBERS FOR ELECTROSTATIC FLOCKING

[75] Inventor: Toni Marti, Lucerne, Switzerland

[73] Assignee: Societe de la Viscose Suisse, Emmenbrucke, Switzerland

[22] Filed: Aug. 27, 1973

[21] Appl. No.: 391,915

[30] Foreign Application Priority Data

Sept. 6, 1972 Switzerland ..... 13114/72

[52] U.S. Cl. ..... 428/394; 427/13; 427/444; 428/395

[51] Int. Cl.[2] ..... B32B 27/02

[58] Field of Search ..... 117/17, 26, 27, 223, 224; 427/13, 322, 444, 222; 428/394, 395

[56] References Cited

UNITED STATES PATENTS 3,322,554 5/1967 Wyss et al. ..... 117/17

*Primary Examiner*—Cameron K. Weiffenbach
*Attorney, Agent, or Firm*—Seidel, Gonda & Goldhammer

[57] ABSTRACT

Flock fibers suitable for use in the manufacture of pile fabrics and materials by electrostatic flocking are treated to improve the electric conductivity of the fibers as well as enlarging the range of humidity in which the fibers retain good conductivity, flow, gliding and spring capacity characterstics. The process comprises treating the fibers, such as polyamides, polyesters, polyacrylonitriles and cellulose triacetate, with an aqueous solution containing a water-soluble alum, and tannin. In a preferred embodiment, the treating solution also includes a water-soluble alkali- or ammonium salt.

13 Claims, No Drawings

PROCESS FOR PREPARING FLOCK FIBERS FOR ELECTROSTATIC FLOCKING

BACKGROUND OF THE INVENTION

The present invention relates to a process for preparation of flock fibers suitable for use in the manufacture of pile materials by electrostatic flocking. The inventive process comprises treating man-made flock fibers with an aqueous solution containing tannin, a water-soluble alum, and preferably also a water-soluble-alkali- or ammonium salt.

The manufacture of plush, velvet, suede, and the like by the application of short fibers, called flock, to an adhesive-coated base under the influence of a high tension electrostatic field is a well-known process, described for example in U.S. Pat. Nos. 2,173,032 and 2,173,078. To obtain a dense and uniform pile, it is necessary to use flock fibers of distinct qualities. The fibers must have good flow and gliding properties allowing an easy supply from a hopper and a smooth passage through any sieves in the flocking apparatus, and they must possess a good spring capacity in an electric field, i.e. the fibers must be able to spring quickly from the supplying electrode to the adhesive-coated base acting as a receiving electrode. For good gliding properties and especially for a good spring capacity in a high tension electrostatic field the electric conductivity of the flock fibers is of greatest importance.

It is known that synthetic fibers made from polymers, such as polyamides, polyesters or polyacrylonitriles have a poor electric conductivity. If unprepared flock fibers of these polymers are used for electrostatic flocking, the fibers tend to cling to each other and to the electrodes, and they spring only slowly or not at all; frequently they also form thick, hard clusters of fibers which cannot pass through the sieves. It is therefore known that synthetic fibers require a preparation with chemical agents in order to obtain the necessary electric conductivity and a good spring capacity in a high tension electrostatic field.

Various chemical agents have been suggested for this purpose. U.S. Pat. No. 3,203,821 describes the use of a combination consisting of an anti-electrostatic agent, a ferro-electric substance, and an agent to improve gliding properties. As examples of antistatica, sodium salts of condensation products of fatty acids and sarcosin, phosphoric acid esters, or anion-active derivatives of polyvinyl alcohol are mentioned, and as ferro-electricum, potassium sodium tartrate, and as agents to improve gliding properties, boric acid or sodium sulphate are recommended.

German Pat. No. 1,098,913 proposes treatment of the fibers with anti-electrostatic agents, such as polyglycol esters or phosphoric acid esters with addition of potassium and sodium salts. U.S. Pat. No. 3,345,980 discloses the use of amphoteric compounds containing both a sodium sulphonate group and a tertiary amine group, and U.S. Pat. No. 3,498,816 recommends the use of quaternary ammonium compounds and of urea with the addition of wetting agents and acrylic polymers.

U.S. Pat. No. 3,322,554 describes a process for treatment of the fibers with tannin and potassium antimonyl tartrate, eventually followed by a treatment with anionic finishing agents and alkali- or ammonium salts or preceded by a treatment with an alum. Flock fibers prepared according to this process possess the required conductivity and show a good spring capacity in an electrostatic field.

BRIEF SUMMARY OF INVENTION

Surprisingly, it has now been found that fibers treated with an aqueous solution containing only tannin, a water-soluble alum, and preferably also a water-soluble alkali- or ammonium salt, possess qualities which considerably surpass those of fibers prepared according to the process disclosed by U.S. Pat. No. 3,322,554.

Thus, the average conductivity of fibers treated according to this invention with tannin and an alum is $2 \times 10^{-10}$(ohm-cm.)$^{-1}$ as compared with a conductivity of $1\text{–}2 \times 10^{-11}$(ohm.-cm.)$^{-1}$ of fibers treated with tannin, potassium antimonyl tartrate, and, conditionally, alum. Especially suitable, however, for use in electrostatic flocking are fibers prepared according to this invention with tannin, alum, and a water-soluble alkali- or ammonium salt. Such fibers have the excellent electric conductivity of $1\text{–}2 \times 10^{-8}$(ohm.-cm.)$^{-1}$ and very good flow and gliding properties. Furthermore, they retain all these properties within the wide range of 30–80% of relative air humidity, and also, when they are heated for a short time up to 150°C. and are cooled down again to room temperature. Fibers prepared according to U.S. Pat. No. 3,322,554 do not possess these valuable properties as shown in the Comparison Example below.

The resistance of the treated fibers to different air humidities and to temporary heating makes the inventive fibers very useful for application in electrostatic flocking. Because of climate differences, change of seasons, and weather conditions, relative air humidity shows great fluctuations. There are places with a relative air humidity of up to 80% during the greater part of the year, while in temperate zones, the relative air humidity may vary between about 75% in summer and 30–40% in heated rooms in winter. To give good results, the fibers used hitherto for electrostatic flocking required a rather narrow range of about 55–65% of relative air humidity, and this could only be realized by the installation of air conditioning devices. The use of the inventive fibers, which retain their good properties within the wide range of 30–80% of relative air humidity, therefore, provides an easier application and greater freedom from technical difficulties.

The second advantage of the inventive fibers already mentioned is their resistance to temporary heating. Following the application of the fibers to an adhesive-coated base in an electrostatic field, the flocked materials are passed through a zone heated up to 120°–150°C. for the purpose of drying. After this operation, those fibers which are not properly fixed are sucked off. While the fibers made according to U.S. Pat. No. 3,322,554 lose their antistatic properties when heated to temperatures above 70°C. and cannot be used again, the inventive fibers retain their properties even when heated for a short time and are ready for re-use in electrostatic flocking.

DETAILED DESCRIPTION OF PREFERRED EMBODIMENTS

As a water-soluble alum, potassium aluminum sulphate is preferred, since it is colorless, cheap, and easily obtainable. As a water-soluble alkali- or ammonium salt, potassium-, sodium-, or ammonium chloride or sulphate may be used; preferably ammonium sulphate is employed. The pH of the solution should be about 3.5–4.5; if an adjustment is required, this can be done with acetic acid. The following quantities of the inventive agents have proved to be suitable:

| | |
|---|---|
| Tannin | 0.3 – 1.0 grams per liter |
| Potassium aluminum sulphate | 1.0 – 2.0 grams per liter |
| Ammonium sulphate | 3.0 – 15 grams per liter |

The weight ratio between fibers and solution should vary between about 1 to 15 and 1 to 25; usually 1 part of fibers require about 20 parts of solution. It is recommended, prior to treatment, to remove any oily or fatty sizes adhering to the fibers. This can be done by washing the fibers in a warm bath containing some soap, soda, or a synthetic detergent.

The fibers are then dispersed in water at about 60°C., the inventive agents dissolved in a little water are added, and the dispersion is stirred for 20 minutes keeping the temperature constant at 60°C. To remove the adhering solution, the fibers are then centrifuged for 10 minutes, and finally dried at room temperature.

By appropriate modification of concentration of the solution and time of treatment, the process can also be used to treat a tow consisting of a multitude of continuous filaments. After treatment, the tow is then cut into short fibers, either wet or dry.

The inventive process is especially suitable for fibers of polyamides, polyesters, polyacrylonitriles, polyvinylchloride, or cellulose triacetate. The fibers may be dyed or undyed; dyeing is preferably carried out before the inventive treatment.

Examples 1–4 describe in detail the application of the inventive process, while the Comparison Example describes treatment and properties of fibers made according to U.S. Pat. No. 3,322,554. All indications about the specific electric conductivity of the fibers refer to tests at 20°C. and 60% of relative air humidity.

EXAMPLE 1

50 Grams of polyhexamethylene adipamide fibers of 1.0 mm length and a titre of 3.3 decitex are stirred for 20 minutes in 1 liter of an aqueous solution of 60°C. containing 0.5 g tannin and 1.0 g potassium aluminum sulphate. The pH of the solution is 3.8. To remove the adhering solution, the fibers are centrifuged, and finally dried at 22°C. The fibers have a specific electric conductivity of $2 \times 10^{-10}$(ohm.-cm.)$^{-1}$. They possess good flow and gliding properties and have a good spring capacity in an electrostatic field at 50–80% relative air humidity.

EXAMPLE 2

50 G of polyhexamethylene adipamide fibers of 1.0 mm length and a titre of 3.3 decitex are stirred for 20 minutes in 1 liter of an aqueous solution of 60°C. containing 0.5 g tannin, 1.0 g potassium aluminum sulphate, and 10 g ammonium sulphate. The pH of the solution is 4.0. The fibers are centrifuged and dried at 22°C. They have a specific electric conductivity of $2.5 \times 10^{-8}$(ohm.-cm.)$^{-1}$. The fibers possess good flow and gliding properties and a very good spring capacity in an electrostatic field at 30–80% relative air humidity. When heated for 10 minutes to 150°C. and cooled again to room temperature, flow and gliding properties and the spring capacity of the fibers in an electrostatic field are as good as before.

EXAMPLE 3

50 G of polycaprolactam fibers of 2.0 mm length and a titre of 22 decitex are stirred for 20 minutes in 1 liter of an aqueous solution of 60°C. containing 0.5 g tannin, 1.0 g potassium aluminum sulphate, and 10 g ammonium sulphate. The pH of the solution is 4.0. The fibers are centrifuged and dried at 22°C. They have a specific electric conductivity of $1 \times 10^{-8}$(ohm.-cm.)$^{-1}$. The fibers possess good flow and gliding properties and very good spring capacity in an electrostatic field at 30–80% relative air humidity. When heated for 10 minutes to 150°C. and cooled again to room temperature, flow and gliding properties and the spring capacity of the fibers in an electrostatic field are as good as before.

EXAMPLE 4

50 G of polyethylene terephthalate fibers of 0.75 mm length and a titre of 3.3 decitex are stirred for 20 minutes in 1 liter of an aqueous solution of 60°C. containing 1.0 g tannin, 2.0 g potassium aluminum sulphate, and 15 g ammonium sulphate. The pH of the solution is 4.1. The fibers are centrifuged and dried at 22°C. They have a specific electric conductivity of $1 \times 10^{-8}$(ohm.-cm.)$^{-1}$. The fibers possess good flow and gliding properties and a very good spring capacity in an electrostatic field at 30–80% relative air humidity. When heated for 10 minutes to 150°C. and cooled again to room temperature, flow and gliding properties and the spring capacity of the fibers in an electrostatic field are as good as before.

COMPARISON EXAMPLE

This Example describes, for the purpose of comparison, treatment and properties of fibers made according to U.S. Pat. No. 3,322,554;

a. 50 g of polyhexamethylene adipamide fibers of 1.0 mm length and a titre of 3.3 decitex are stirred in 1 liter of an aqueous solution of 60°C. containing 0.5 g tannin and 0.2 g 80% acetic acid. After 10 minutes, 0.25 g of potassium antimonyl tartrate are added and stirring is continued for another 10 minutes. The fibers are centrifuged and then dried at 22°C. They have a specific electric conductivity of $1 \times 10^{-11}$(ohm.-cm.)$^{-1}$.

If the solution contains, in addition, 1.0 g of potassium aluminum sulphate, or if the fibers are pre-treated with 1 liter of an aqueous solution containing 1.0 g of potassium aluminum sulphate, the specific electric conductivity of the fibers is $2.5 \times 10^{-11}$(ohm.-cm.)$^{-1}$.

The spring capacity in an electrostatic field of the fibers made with or without use of potassium aluminum sulphate is restricted to a range of 55–65% relative air humidity.

b. 50 g of polyhexamethylene adipamide fibers of 1.0 mm length and a titre of 3.3 decitex are stirred in 1 liter of an aqueous solution of 60°C. containing 0.5 g tannin and 0.2 g 80% acetic acid. After 10 minutes, 0.25 g of potassium antimonyl tartrate are added and stirring is continued for another 10 minutes. The fibers are centrifuged and then stirred for 25 minutes in 1 liter of an aqueous solution of 50°C containing 3 g of a mixture of cetyl alcohol and cetyl ammonium sulfonate and 10 g of ammonium sulphate. The fibers are again centrifuged and then dried at 22°C. They have a specific electric conductivity of $5 \times 10^{-10}$(ohm.-cm.)$^{-1}$.

The fibers have a good spring capacity in an electrostatic field which is however restricted to a range of 55–65% relative air humidity. When heated for 10 minutes to 90°C. and cooled again to room temperature, the fibers have lost their spring capacity.

The present invention may be embodied in other specific forms without departing from the spirit or essential attributes thereof and, accordingly, reference should be made to the appended claims, rather than to the foregoing specification as indicating the scope of the invention.

I claim:

1. Process for preparing flock fibers suitable for use in the manufacture of pile materials by electrostatic flocking which comprises treating flock fibers made of polymers selected from the group consisting of polyamides, polyesters, polyacrylonitriles, polyvinyl chloride, and cellulose triacetate with an aqueous solution consisting essentially of tannin and a water-soluble alum, wherein the preparation of said flock fibers excludes any pre-treatment or post-treatment with an aqueous solution containing potassium antimonyl tartrate.

2. Process according to claim 1 wherein said aqueous solution is adjusted, if necessary, to a pH of about 3.5 to 4.5 with acetic acid.

3. Flock fibers prepared by the method of claim 1.

4. Process according to claim 1, in which the water-soluble alum is potassium aluminum sulphate.

5. Process according to claim 4 wherein said aqueous solution contains about 0.3 to 1.0 grams per liter of tannin and 1.0 to 2.0 grams per liter of potassium aluminum sulphate.

6. Flock fibers prepared by the method of claim 4.

7. Process for preparing flock fibers suitable for use in the manufacture of pile materials by electrostatic flocking which comprises treating flock fibers made of polymers selected from the group consisting of polyamides, polyesters, polyacrylonitriles, polyvinyl chloride, and cellulose triacetate with an aqueous solution consisting essentially of tannin, a water-soluble alum and a water-soluble alkali- or ammonium salt, wherein the preparation of said flock fibers excludes any pre-treatment or post-treatment with an aqueous solution containing potassium antimonyl tartrate.

8. Flock fibers prepared by the method of claim 7.

9. Process according to claim 7, wherein the water-soluble alkali- or ammonium salt is selected from the group consisting of the chlorides of potassium, sodium and ammonium, and the sulphates of potassium, sodium and ammonium.

10. Flock fibers prepared by the method of claim 9.

11. Process according to claim 7, in which the water-soluble alkali- or ammonium salt is ammonium sulphate.

12. Process according to claim 11 wherein said aqueous solution contains about 3.0 to 15 grams per liter of ammonium sulphate.

13. Flock fibers prepared by the method of claim 11.

* * * * *